United States Patent [19]

Booth

[11] 3,998,339

[45] Dec. 21, 1976

[54] PATTY STACKER

[75] Inventor: Raymond E. Booth, Huron, Ohio

[73] Assignee: Sam Stein Associates, Inc., Sandusky, Ohio

[22] Filed: Aug. 15, 1975

[21] Appl. No.: 604,996

Related U.S. Application Data

[63] Continuation of Ser. No. 427,703, Dec. 26, 1973, abandoned.

[52] U.S. Cl. ..... 214/6 D; 214/6 DK; 214/6 S; 271/223

[51] Int. Cl.[2] ..... B65G 57/14

[58] Field of Search ..... 214/6 DK, 6 D, 6 P, 214/6 H, 6 S, 152; 271/223, 224, 248, 253, 254, 255; 93/93 DP; 198/162, 165, DIG. 16

[56] References Cited

UNITED STATES PATENTS

| | | | |
|---|---|---|---|
| 2,759,615 | 8/1956 | Banks | 214/6 DK |
| 3,006,258 | 10/1961 | Jochem | 93/93 DP |
| 3,346,128 | 10/1967 | Hullhorst | 214/6 DK |
| 3,392,853 | 7/1968 | Mitchell et al. | 214/6 DK |
| 3,525,443 | 8/1970 | Pomara | 214/6 DK |
| 3,593,624 | 7/1971 | Dufour | 214/6 DX |
| 3,641,735 | 2/1972 | Daily et al. | 214/6 DK X |
| 3,662,901 | 5/1972 | Brintley | 214/6 H |

FOREIGN PATENTS OR APPLICATIONS

| | | | |
|---|---|---|---|
| 307,769 | 1/1969 | Sweden | 214/6 DK |

*Primary Examiner*—L. J. Paperner

*Attorney, Agent, or Firm*—Baldwin, Egan, Walling & Fetzer

[57] ABSTRACT

A patty stacker is presented which is fully adjustable over a wide range of length, width and thickness of frozen or reasonably stiff meat patties or other flat food shapes hereinafter called patties; which accepts a predetermined configuration of individual patties either plain or frozen on a rectangle of paper from the discharge point of a separate conveying means in one or more parallel independent lanes; which quickly attains and retains a reasonably positive hold on the individual patty as it enters the conveying means; which accelerates the patty to a predetermined rate of speed; which conveys the patty in a horizontal plane past patty sensing means; which delivers the patty in a reasonably controlled manner into the top of a substacking volume; which counts patties into a reasonably stable substack at a level below the plane of the conveying means; which drops the substack in a reasonably controlled manner into a main stack volume; which repeats the substacking operations as necessary to obtain the predetermined full stack count required; which moves the counted and completed stack out of the stack volume to a take-away conveyor in a reasonably controlled manner while the first substack of a new stack is being formed; and to do all of the above at high speed, say at about the rate of 120 patties per minute per lane.

9 Claims, 19 Drawing Figures

PATTY STACKER

This is a continuation of application Ser. No. 427,703, filed Dec. 26, 1973 and now abandoned.

BACKGROUND OF THE INVENTION

Previous stackers for patties have lacked dependability in accurately counting the stacks and in moving the stacks out of the machine quickly while protecting stack orientation. In some other stackers, the finished stack must be moved out of the way in the interval required to handle a single patty, which either increases the patty interval, thus slowing down the entire machine, or requires other mechanism to protect stack orientation during fast stack removal.

An object of the present invention is to provide one or more parallel independent lanes, each of which receives a series of patties, conveys them at a reasonably high rate of speed to a discharge point where each patty is impelled outwardly and slightly upwardly and then deflected into a horizontal plane, if necessary, and stopped at a predetermined point where it is allowed to drop into a substack supported upon a reciprocatable stacker plate. When a selected set number of patties has been received into a substack, the stacker plate is removed quickly from its supporting position, thus dropping the substack without any substantial tilting thereof into a finished stack volume below. Control means continues the counting and stacking of substacks until a predetermined count of the finished stack is reached. Thereafter, the finished stack is moved out of the stack volume, the arrangement being such that the delivery of the completed stack takes place in the stacking interval required for at least two patties which permits a gentle handling of the finished stack which protects the stack orientation without slowing down the operation of the machine.

Other objects and advantages of this invention will be apparent from the accompanying drawings and description and the essential features thereof will be set forth in the appended claims.

In the drawings,

FIG. 17 is a sectional view, enlarged, taken on the line 17—17 of FIG. 5; while

Figure 5:
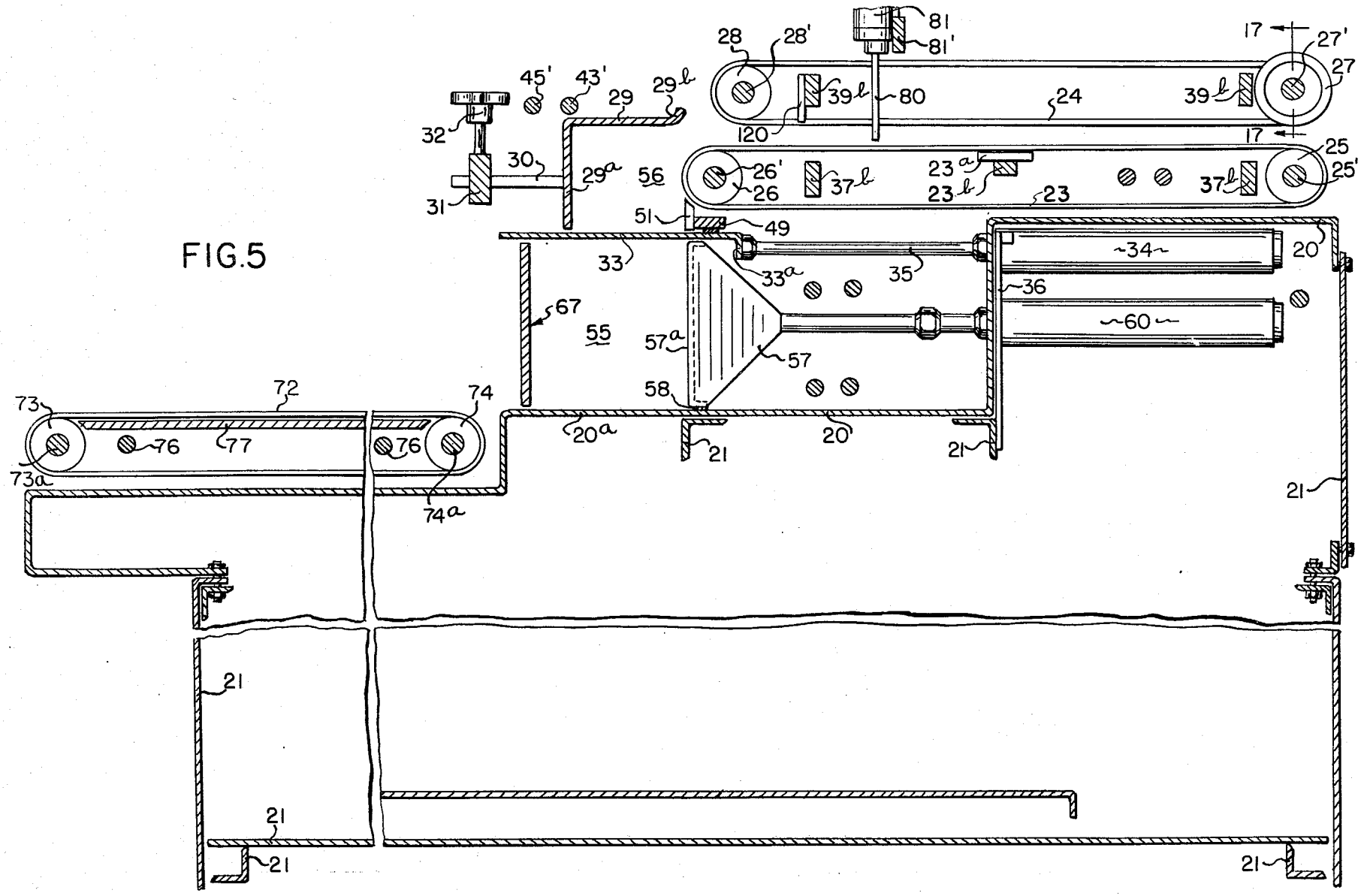
FIG. 5 is a sectional view taken along the line 5—5 of FIG. 2.
Figure 6:
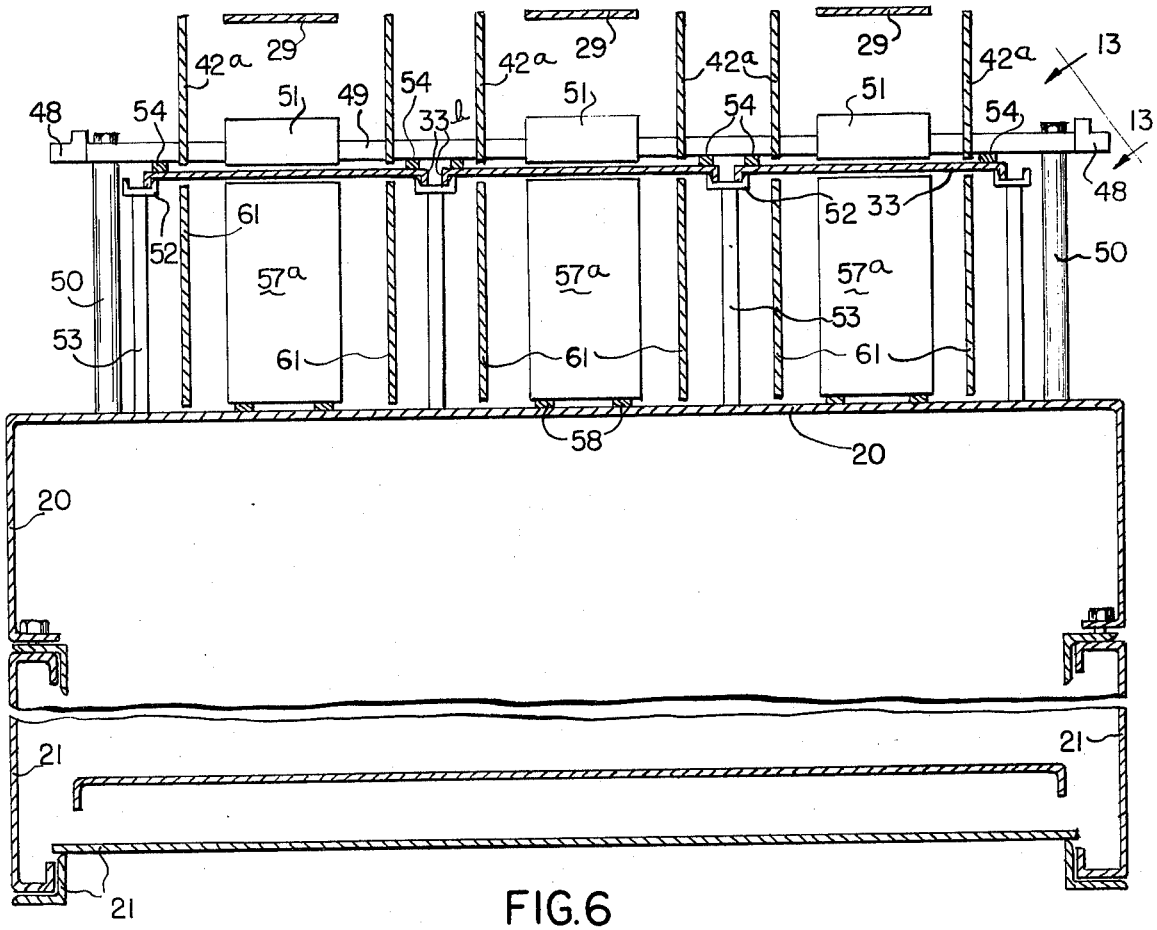
FIG. 6 is a sectional view taken along the line 6—6 of FIG. 4.
Figure 7:
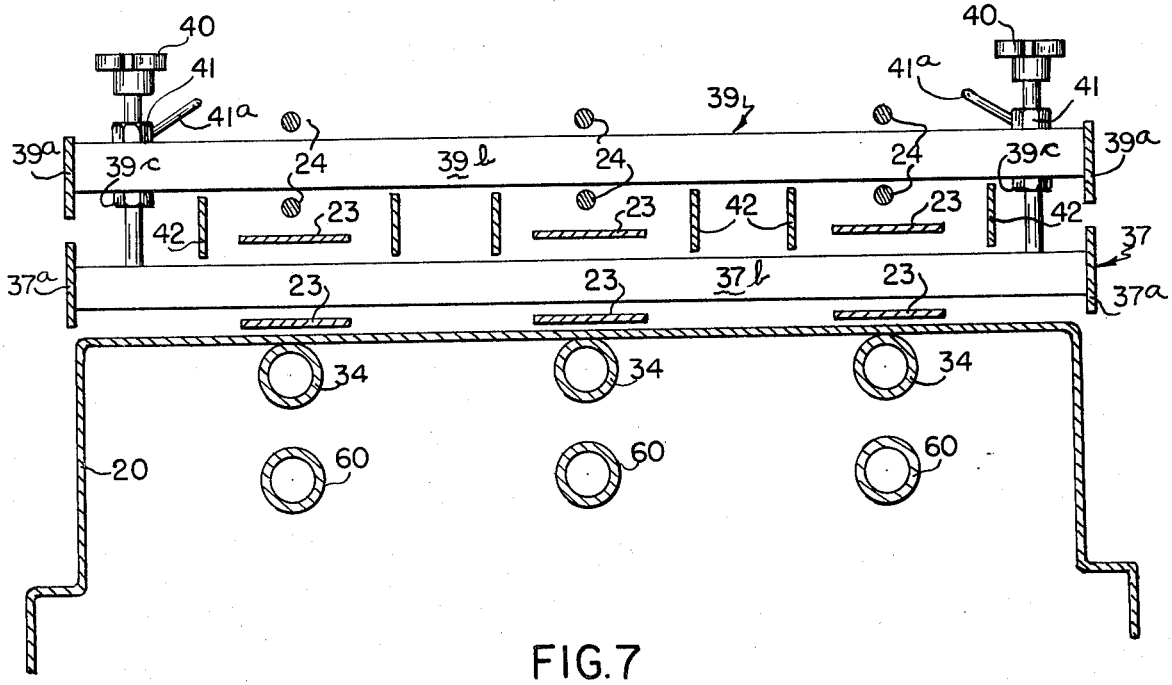
FIG. 7 is a sectional view taken along the line 7—7 of FIG. 4.

It should be understood that the apparatus herein described may be used in a single lane arrangement to provide meat patty stacks, but more economically, and for the handling of a larger volume of product, it would generally be used involving a plurality of parallel independent lanes. The present description shows one embodiment having three separate lanes for handling the patties. Referring now to FIGS. 5 through 7, the equipment is supported on a main frame which is indicated at 20 in FIG. 5 where the frame supports the mechanism on top of the machine and it in turn is supported by additional structure as shown at 21 which encloses the sides of the machine and extends down to the floor where a plurality of supporting wheels 22 are attached, usually of the swiveling type.

Figure 1:
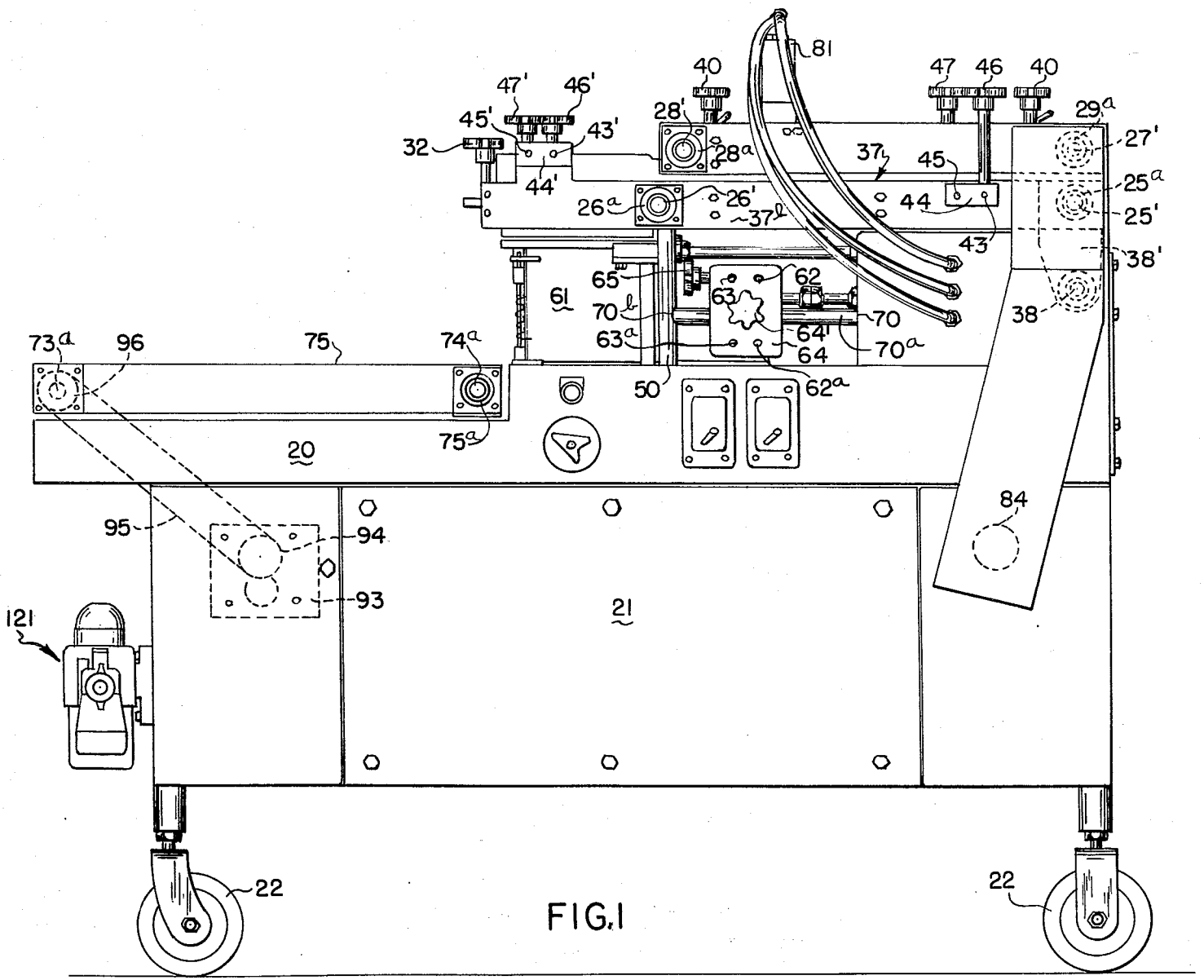
FIG. 1 is a side elevational view of one embodiment of this machine.
Figure 3:
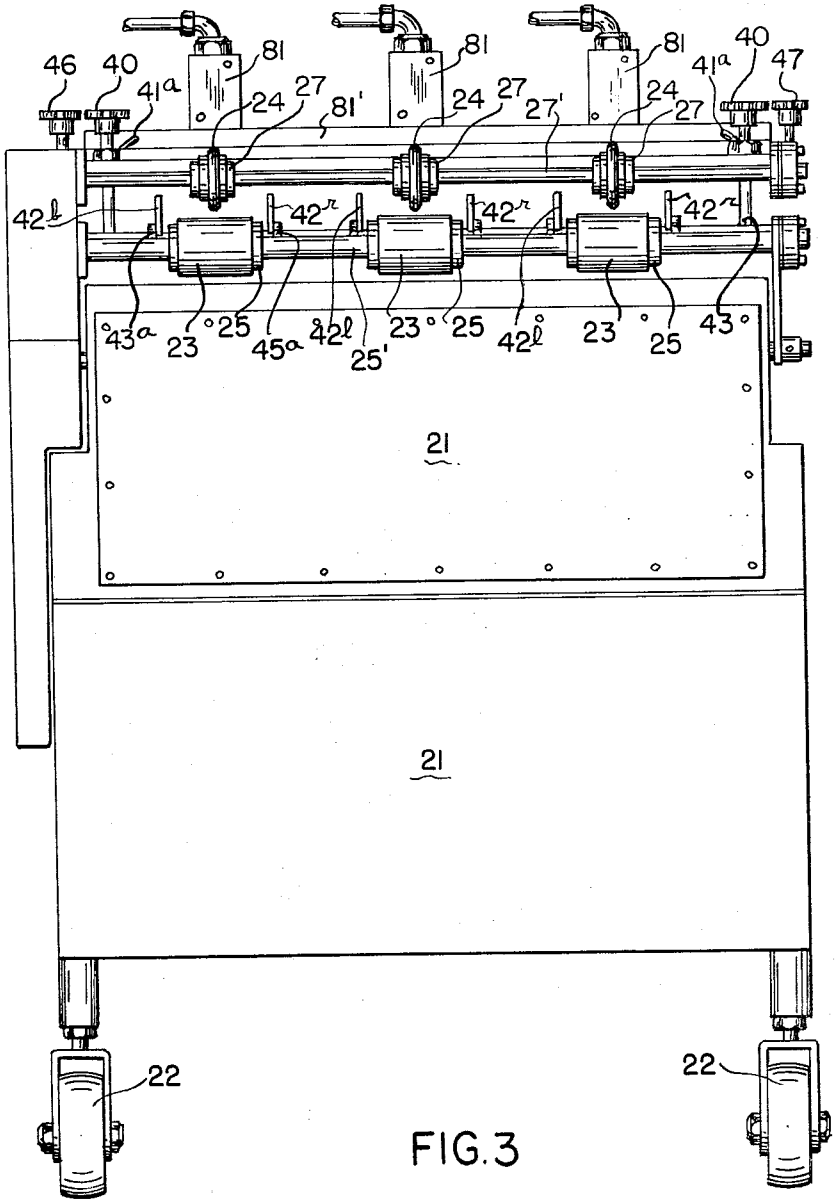
FIG. 3 is an end elevation of the same taken at the right-hand end of FIG. 1.
Figure 4:
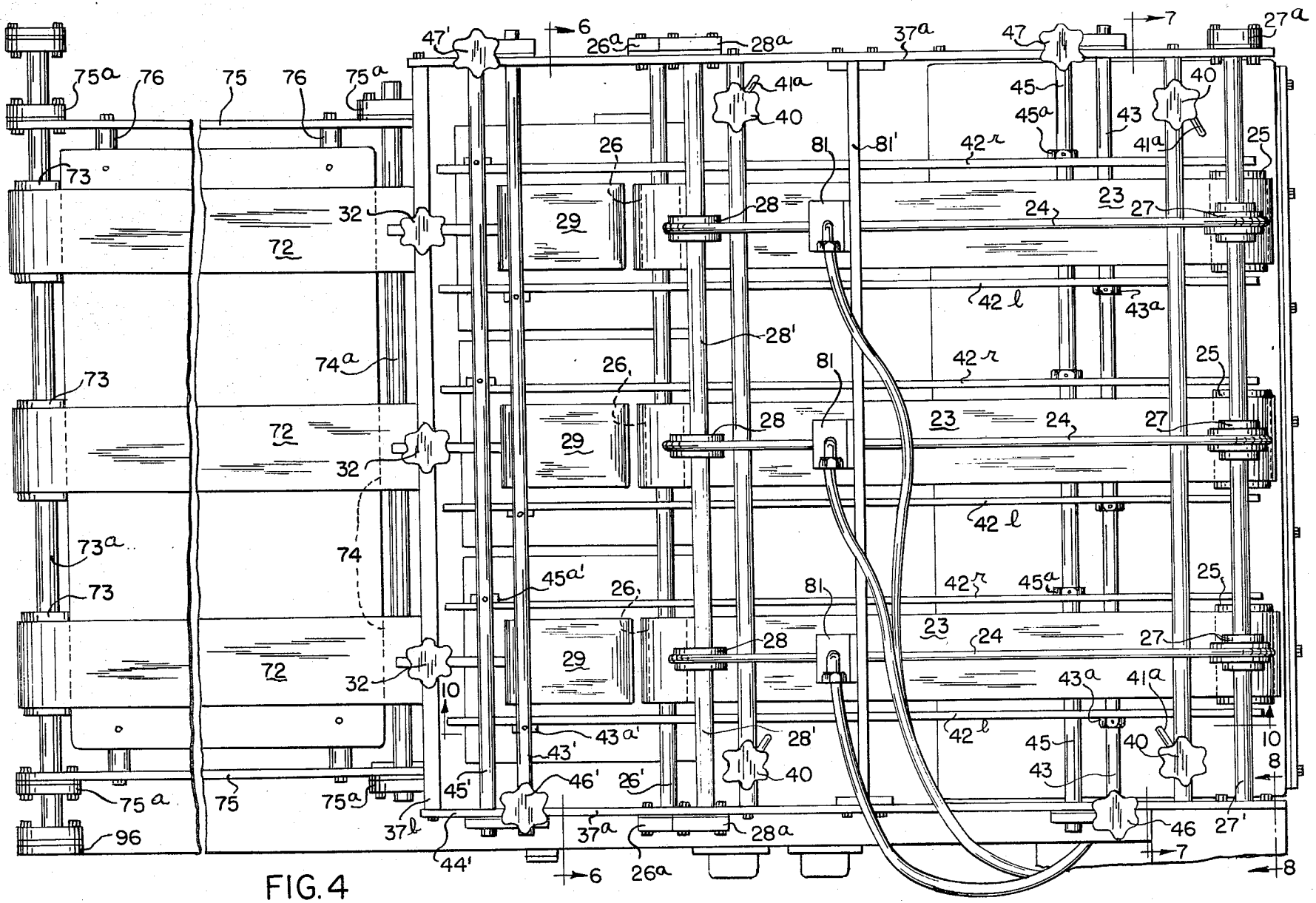
FIG. 4 is a top plan view of the same.
Figure 17:
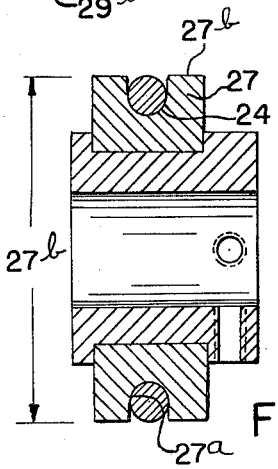

At the product entering end of the machine shown at the right-hand side of FIGS. 1, 4 and 5, means is provided for feeding a plurality of patties in succession along a linear path of travel. This comprises an endless feed belt 23 and an endless hold-down belt 24, above and parallel to the feed belt, which is a round belt, that is, circular in section. The feed belt in this embodiment is flat, three inches wide, and known as a food grade endless belt. This is of polyester coated with Buna-N. This feed belt is carried on a drive pulley 25 and an idler pulley 26. Preferably, the pulleys 25 are slightly crowned so that the belt is self-centering. Pulleys 26 are cylindrical. The hold-down belt in this embodiment is of food grade synthetic material, the one shown known as Tygon which is a trademark indicating a product of U.S. Stoneware Co. which material is composed of modified halide polymers, condensation resins, and diene derivatives compounded. This belt is carried on drive pulley 27 and idler pulley 28, both of which are grooved as shown at 27*a* in FIG. 17. It will be noted in FIG. 5 that the axis of the inlet hold-down pulley is in the same vertical plane as the axis of the inlet feed belt pulley so that a pinching action is obtained between these two pulleys. Preferably, the grooved part of the inlet hold-down pulley 27 is made of soft food grade rubber, say about 35–40 Durometer, with an outside diameter at 27*b* which is slightly larger than the outside diameter of the belt 27 in its groove so as to increase the positive action of the pinch between pulley 27 at its diameter 27*b* and the belt 23 traveling around its pulley 25. This quickly snatches the patty between the two pulleys and accelerates it to the speed of the feed belt. The hold-down belt serves to keep the patty in contact with the feed belt, and hence to maintain the patty speed at belt speed, regardless of patty or paper drag on the patty side guides mentioned later, and regardless of slight resistance encountered when passing a patty sensing means hereinafter described.

It was found during experimentation that variation in patty forming and handling creates minor imperfections in the patty configuration. If, then, the discharge pulley 28 of the hold-down belt 24 were directly above the discharge pulley 26 of the feed belt, considerable variation occured in the discharge path of the patty leaving the conveyor. Therefore, a preferred form of the device shown in FIG. 5 places the axis of rotation of the hold-down belt idler pulley 28 in a vertical plane upstream of the axis of rotation of the feed belt idler pulley 26 as clearly seen. In one embodiment of the machine, this out-of-line relationship is about ¾ inches. Due to the slight compression of the patty between the belts 23 and 24, the patty has a tendency to climb above the horizontal plane of the feed belt 23 as it leaves the conveyor structure shown in FIG. 5. This more or less depends upon the imperfections of the patty previously mentioned. The extent of climbing is controlled by a hold-down or deflector plate 29 which forms the horizontal portion of a generally L-shaped stop member which has a vertical stop portion at 29*a*. Integral with the stop is a control bar 30 which passes through an opening in a suitable frame member 31 and the adjustment controlled by a hold-down screw 32. The deflector portion 29 is slightly above the level of the upper surface of a patty lying on the feed belt 23 and its end toward the oncoming patty is preferably upturned at 29*b* in a position to catch a patty climbing upward and outward and to direct the same in a substantially horizontal path until the patty strikes the stop vertical portion 29*a*.

Figure 9:
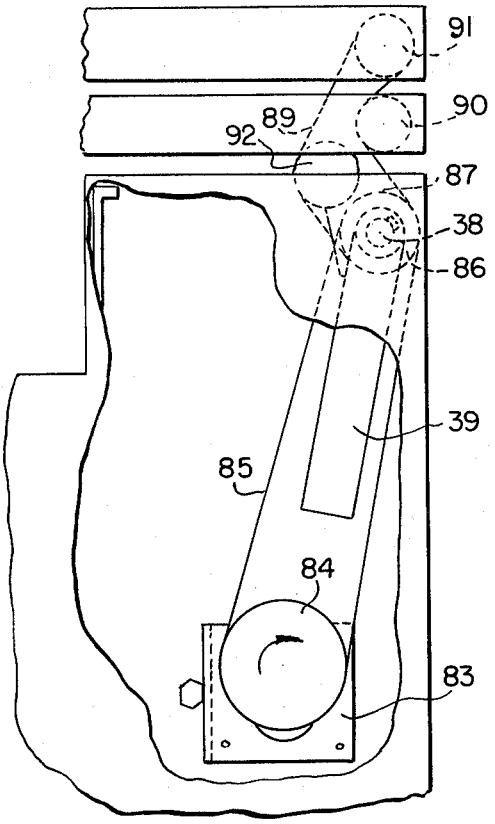
FIG. 9 is a fragmental elevational view taken from the line 9—9 of FIG. 8.
Figure 8:
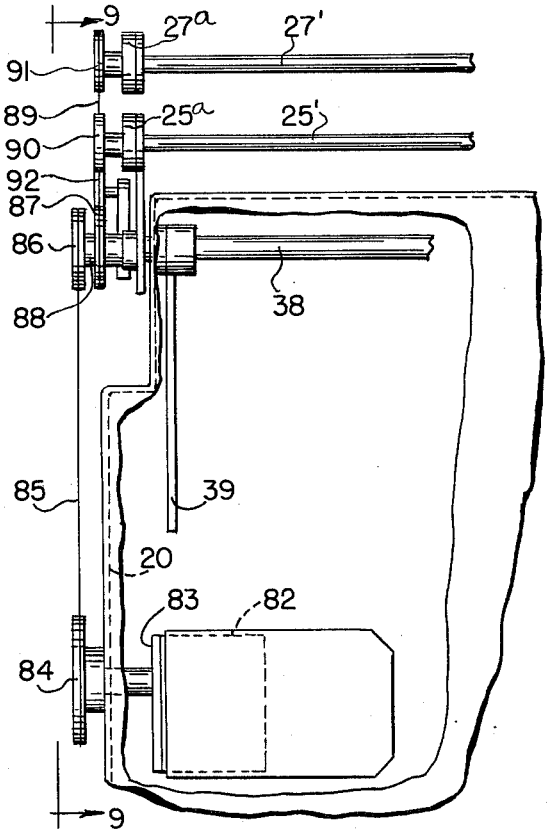
FIG. 8 is a view taken along the line 8—8 of FIG. 4.

Each substack is caught on a reciprocable stacker plate 33 which forms the floor of a substack volume 56 and remains in supporting position until a selected set number of patties have been stacked thereon, after which control means, later described, reciprocates the stacker plate rearwardly or to the right in FIG. 5 by means of a double acting, air-operated, cylinder and piston motor 34 which has its piston connected by piston rod 35 to the stacker plate. The motor 34 is supported by a backup plate 36 which in turn is secured to the frame 20. A subframe 37 supports all of the feed belt conveyors 23 as will be seen in FIGS. 1, 2, 4 and 7. Two parallel side frame members 37*a* are rigidly connected by side frame spreader members 31, 23*b* and 37*b*. This subframe is arranged to be pivoted in a clockwise direction as seen in FIG. 1 on a pivot shaft 38 which is supported in bearings at its opposite ends in the frame 20 and is limited in such pivoting action by a stop bar 39 which is shown in FIGS. 8 and 9 as being rigidly connected to the pivot shaft 38. The subframe 37 is rigidly connected to pivot shaft 38 by means of two parallel ears 38' which are respectively a part of each of the side frame members 37*a*. Three drive pulleys 25 are fixed in space relationship along the shaft 25' to rotate therewith and three idler pulleys 26 are spaced along the shaft 26' to rotate therewith. It should be understood that these pulleys 25 are preferably slightly crowned so that the belt 23 will be self-centering, but it is difficult to show such crowned relationship in the drawing. The shafts 25' and 26' are received in suitable bearings at 25*a* and 26*a*, respectively, in the side frame members 37*a* as shown in FIG. 1. A feed belt slide 23*a* is shown in FIG. 5 supported on a slide support 23*b* which is a strut extending between the side frame members 37*a*. This slide is provided substantially midway between the pulleys 25 and 26 so that the feed belt will not sag in the middle of its travel, nor flap vertically to affect operation of sensing member 80.

Another subframe 39 is provided for all of the hold-down belts 24. This comprises side frame members 39*a* which are rigidly connected by spreaders 39*b* at the front and rear as seen in FIG. 5. The pulleys 27 are spaced along drive shaft 27' as shown in FIG. 4 and fixed to the shaft so as to rotate with it. The pulleys 28 are fixed along idler shaft 28' as shown in FIG. 4 so as to rotate with the shaft. The shafts 27' and 28' are mounted in suitable bearings at their opposite ends in the side frame members 39*a* as indicated respectively at 27*a* and 28*a*.

Means is provided for adjusting the spacing between the feed belt 23 and the hold-down belt 24. For this purpose, there are shown four hold-down lock studs 40, each having an actuator knob, and each being so threaded between the subframe 37 and 39 so that turning the knobs of the lock studs will move the frame 39 toward or away from the subframe 37. This position is then secured by lock nuts 41 manipulated by handles 41*a*.

Patty side guides are provided along the full length of each side of the feed belt in each lane. These are shown as vertical plates 42 in FIGS. 3, 4, 7 and 10. These plates extend along substantially the entire upper run of each side of each feed belt 23. These are marked 42L for those on the left-hand side of belt 23 looking from the inlet end of the machine and are marked 42R for the guides on the right-hand side of each belt 23.

Figure 10:
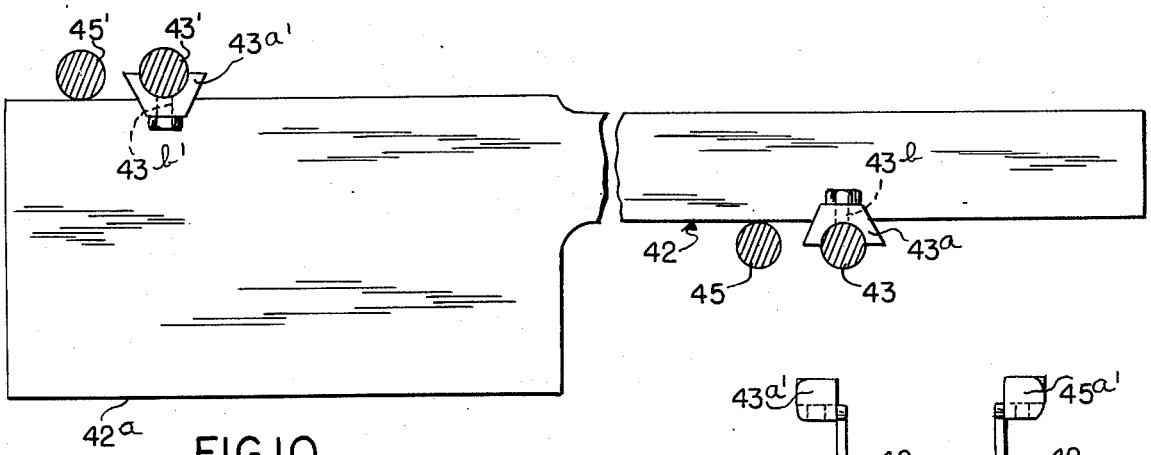
FIG. 10 is a view taken along the line 10—10 of FIG. 4 showing a combined patty guide and substack volume wall.
Figure 11:
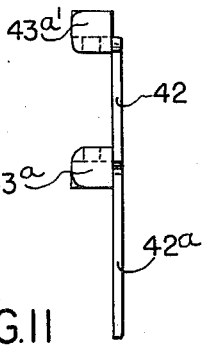
FIGS. 11 and 12 are end views, respectively, of a left-hand and right-hand patty guide.
Figure 12:
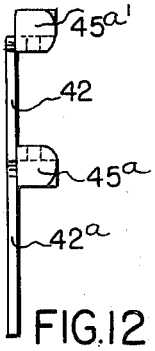

As clearly seen in FIG. 10, each of these patty guides becomes a plate of greater depth at 42A where it passes beyond the discharge end of the feed belts. The parts at 42*a* form the side walls of each substack volume 56 extending between stacker plate 33 and the deflector portion of the stop member at 29*b*. These patty side guides are adjustable toward and away from their associated feed belt 23 to accommodate patties of different width. Means is provided for simultaneously adjusting all of the left-hand side guides at one time and for adjusting all of the right-hand side guides at another time. For this purpose, all of the left-hand patty guides 42L are firmly secured to a horizontal rod 43 which is common to all lanes and extends from side to side of the machine passing slidingly through a plate 44 fastened to the subframe side member 37*a* at each end. In a like manner, all of the right-hand side patty guides 42R are secured to a common rod 45 which runs through the machine from side to side and through suitable openings in the plates 44 mentioned above. All of the left-hand side guides are secured firmly to the rod 43 using half collars 43*a* or 43*a'* as shown in FIGS. 10 and 11. These are secured by a bolt or the like passing through the fitting 43*a* or 43*a'* at 43*b* and 43*b'*. In a similar manner, all of the right-hand side patty guides 42R are secured to the rod 45 by half collars 45*a* 45*a'* shown in FIGS. 4 and 12 and secured to the associated rod in the same manner as described at 43*a*, 43*b*. A similar structure is shown at the other end of the conveyor system beyond the discharge point of the feed belts 23. This will be understood from FIGS. 4 and 10 as consisting of rod 43' extending from side to side of the machine and slidable through suitable openings in plates 44' fastened to each of the side frame members 37*a*. Each of the left-hand members 42*a* (as seen in FIG. 10) is firmly secured to its associated rod 43' by means shown at 43*a'* and 43*b'* in FIGS. 10 and 11. Likewise, a rod 45' extends across the machine and through the plates 44' and is secured to each of the right-hand side guides by fixtures as shown at 45*a'* in FIGS. 4 and 12 as associated with FIG. 10. The bars 43, 45, 43' and 45' are of sufficient length so as to permit considerable movement of the patty guides 42L and 42R away from the feed belt 23 so as to accommodate patties of any width usually encountered. The bar 43 is held in adjusted position by the lock stud 46 and the bar 45 is held in adjusted position by lock stud 47. In a similar manner, bar 43' is held in adjusted position by lock stud 46' and bar 45' is held in adjusted position by lock stud 47'. In practice, the lock studs 46 and 46' are loosened and bars 43 and 43' are manually adjusted. In like manner, the lock studs 47 and 47' are loosened and the bars 45 and 45' are adjusted simultaneously. In this manner, all of the left-hand guides are adjusted simultaneously and all of the right-hand guides are also adjusted simultaneously.

When the feed conveyor and hold-down belts are in their operating position, the subframe side members 37*a* rest upon supports 48 which are mounted on a cross bar 49 running from side to side of the machine and secured to posts 50 which are fastened to the frame 20.

The bar 49 also supports a plurality of belt guards 51, each of which is directly opposite the discharge end of one of the feed belts 23.

Figure 2:
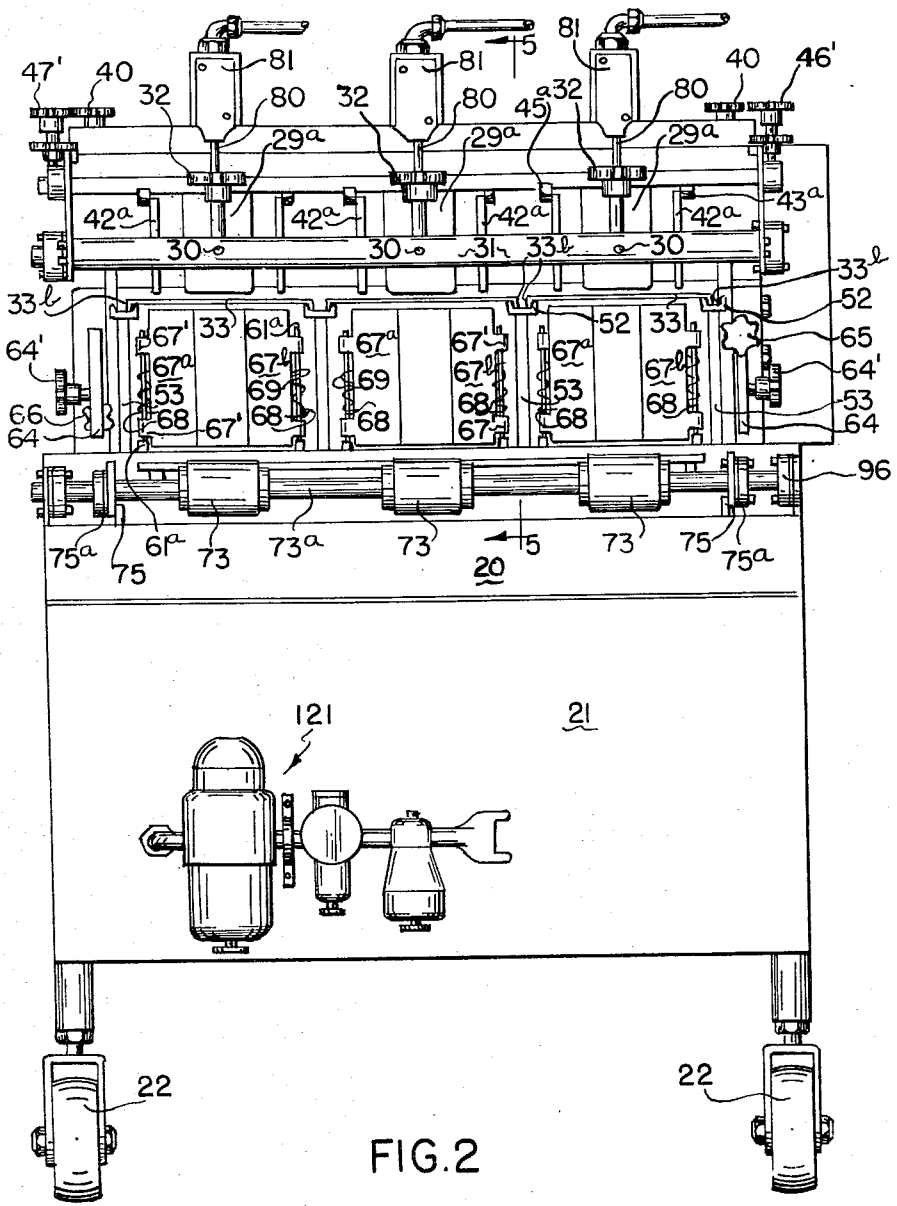
FIG. 2 is an end elevation taken at the left-hand end of FIG. 1.

The stacker plate 33 has a downturned flange across its rear edge at 33*a* which is secured to the piston rod 35 as previously described. The stacker plate also has two downturned flanges 33*b* on parallel opposite edges which travel in stack plate guides 52 which are clearly seen in FIGS. 2 and 6 and each of these guides in a short upturned channel rigidly supported on a vertical post 53 mounted on the frame 20. In FIGS. 2 and 6, it will be noted that there is one of these channel guides for the outermost flange 33*b* in each of the outer lanes, while one guide is provided between lanes 1 and 2 and another guide between lanes 2 and 3. Each guide 52 engages the forward edge of its associated stacker plate when the same is in retracted position and extends forwardly therefrom a few inches so as to guide the stacker plate as it is pushed forward. Each stacker plate engages two Nylon wear buttons 54 mounted in proper position on the cross bar 49 as seen in FIG. 6. These engage the upper surface of the associated stacker plate 33.

In each lane, there is a finished stack volume 55 located directly below the substack volume 56 and extending from the stacker plate 33 down to a portion of the frame indicated at 20*a* and herein referred to as a finished stack support fixed on the frame. At the rear side of the stack volume is a pusher 57 having a vertical pushing face 57*a* which is substantially the width of a minimum size patty and which extends for almost the entire distance of the vertical height of the stack volume 55 as clearly seen in FIG. 5. Preferably, each pusher has one or more wear buttons 58 at the bottom where it slides along the frame 20, 20*a*. The rear side of the pusher is rigidly connected to a piston rod 59 of a cylinder and piston motor 60. This motor is firmly supported from the cylinder back-up plate 36.

Figure 13:
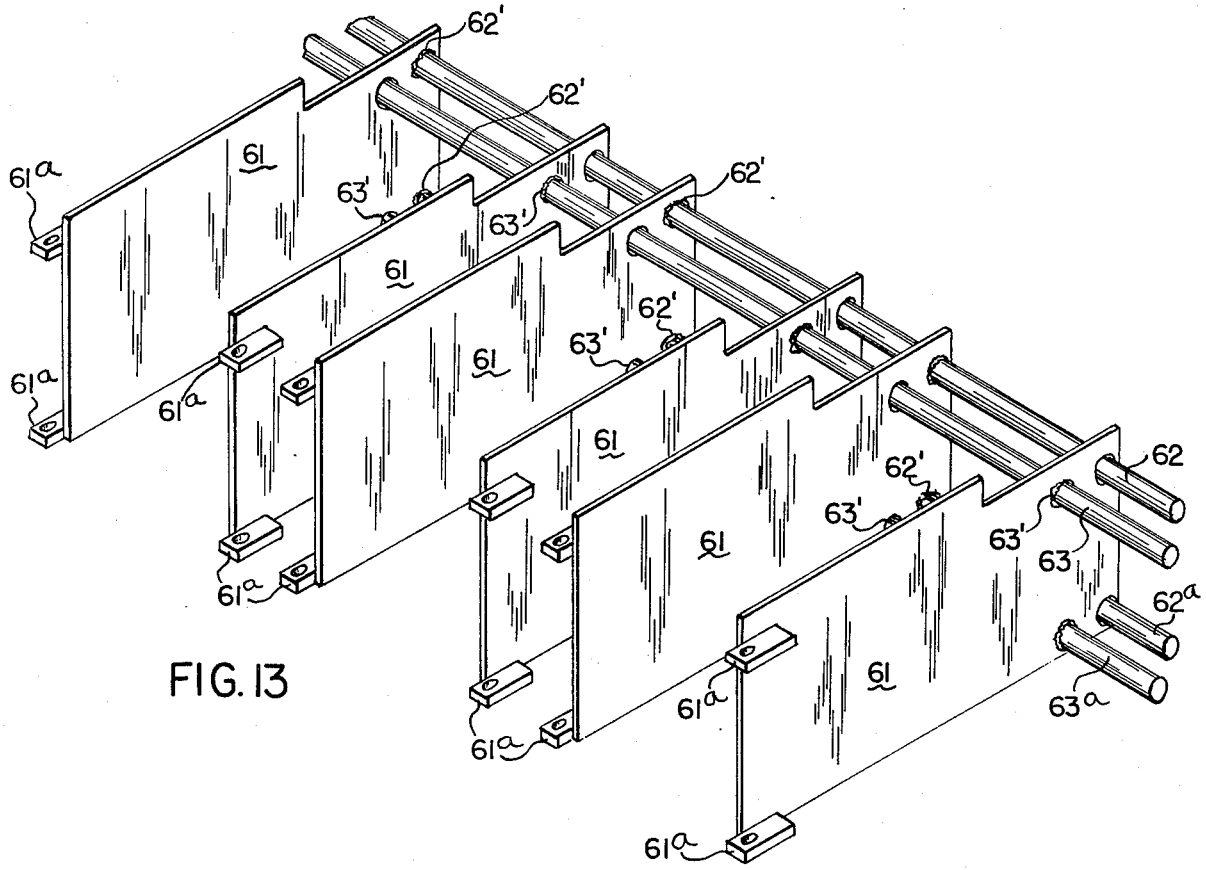
FIG. 13 is a view taken generally along the line 13—13 of FIG. 6 showing an assembly of stack guides for a plurality of lanes with all other parts of the apparatus removed for clarity.
Figure 14A:
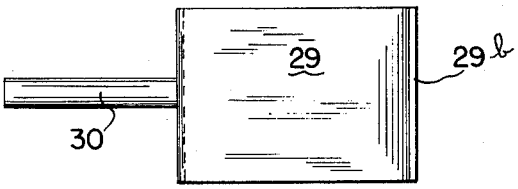
FIG. 14A is a top plan view of the same.
Figure 16:
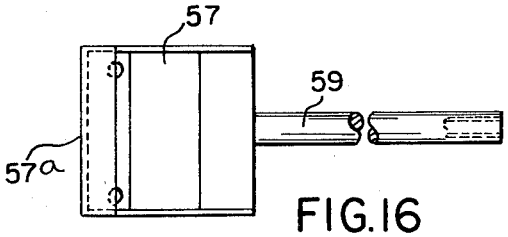
FIG. 16 is a top plan view of FIG. 15.
Figure 14:
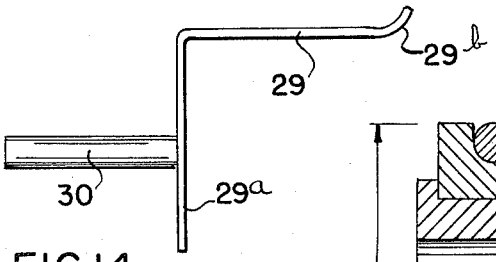
FIG. 14 is a side elevational view of a patty stop and deflector as seen in the upper mid-portion of FIG. 5.
Figure 15:
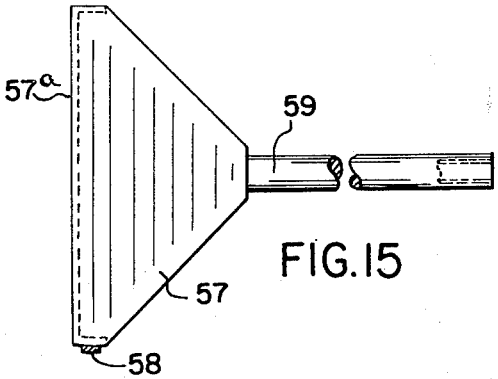
FIG. 15 is a side elevational view of a stack pusher as seen in the mid-portion of FIG. 5.

The side walls of each stack volume 55 are formed by parallel vertical stack guide plates 61 of which there are a pair for each lane. As clearly seen in FIG. 1 and FIG. 13 all stack guides are supported on four common cross rods as seen in FIG. 13. The upper cross rod 62 is vertically above the lower cross rod 62*a*, while the upper cross rod 63 is vertically above the lower cross rod 63*a*. All of these cross rods are parallel and the upper rods are in a common horizontal plane and the same is true of the lower cross rods. Each of the rods 62 and 62*a* is rigidly secured to all of the right-hand stack guides 61 as indicated at 62'. All of the rods 63 and 63*a* are rigidly secured to the left-hand stack guides 61 as indicated at 63'. At each side of the machine, the four cross rods pass slidingly through a cross head 64 as clearly seen in FIG. 1. All of the cross rods are long enough to extend through the cross heads 64 at both sides of the machine at any desired separation of the stack guides 61 in their various lanes. A lock stud 65 on the left-hand side of the machine as seen in FIGS. 1 and 2 serves to lock all of the left guide control bars 63 in adjusted position while lock stud 66 on the opposite side of the machine serves to lock all of the right-hand slide control bars 62 in adjusted position. Thus, all of the stack guide plates 61 may be adjusted by manually loosening the lock studs 65 and 66, then manually adjusting the stack guides and again tightening the lock studs 65 and 66.

Door means is used to control the front wall of each stack volume 55 as indicated at 67. In a preferred form, the door means comprises two vertical half doors 67*a* and 67*b*, each of which is supported to swing about a vertical pivot as represented by pivot pins 68 as seen in FIG. 2 as passing through ears 67' on the door members, which pins in turn are held in holes in suitably placed brackets 61*a* welded to each stack guide 61 as seen in FIG. 13. A torsion spring 69 is spirally wound around each pin 68 with its opposite ends bearing against opposite sides of its associated door member and under sufficient tension to bias the doors toward closed position.

Means is provided for moving all of the stack guides and their attached doors longitudinally forward and back to vary the length of the stack volumes 55. Referring to FIG. 1, this is done by mounting the cross heads 64 on opposite sides of the machine, each one a cross head slide bar 70 which is rigidly connected at one end 70*a* to the frame 20 and at the other end 70*b* to vertical post 50 fixed between frame 20 and bar 49. Thus, by siding the two cross heads 64 on the two cross head slides 70 all of the stack guide plates 61 and their associated doors 67*a* and 67*b* are moved backward and forward simultaneously so as to adjust the length of the stack volume 55. Such adjustment is held in the desired position by lock studs 64', each threaded into one of the cross heads 64 and engaging against the associated slide 70 to maintain the desired position.

Means is provided for carrying away the completed stacks of patties and this is here shown as a plurality of takeaway conveyors 72 having their upper runs located at the horizontal level of the fixed stack support 20*a* and driven in a direction to carry the stacks toward the left as viewed in FIGS. 1, 4 and 5. Each conveyor is a web belt conveyor similar to the feed belt 23 and passing over a drive pulley 73 at one end and an idler pulley 74 at the other end. Here again, the pulleys 73 are desirably crowned so as to maintain the belt centered and pulleys 74 are cylindrical. Pulleys 73 are spaced along and secured to the drive shaft 73*a* as seen in FIG. 4. Likewise, the pulleys 74 are equally spaced along the shafts 74*a* and secured thereto. The shafts 73 and 74 have suitable bearings 75*a* which are mounted in the side frame members 75 of a frame assembly which supports all of the conveyors 72. Struts or spreader members 76 are rigidly secured between the side frames 75. Preferably, a slide plate 77 is rigidly secured to the spreader members 76 in a position to support the major portion of the length of the top run of each of the belts 72.

A single low torque limit switch 80, one for each lane, controls all of the operating functions of that lane.

Figure 18:
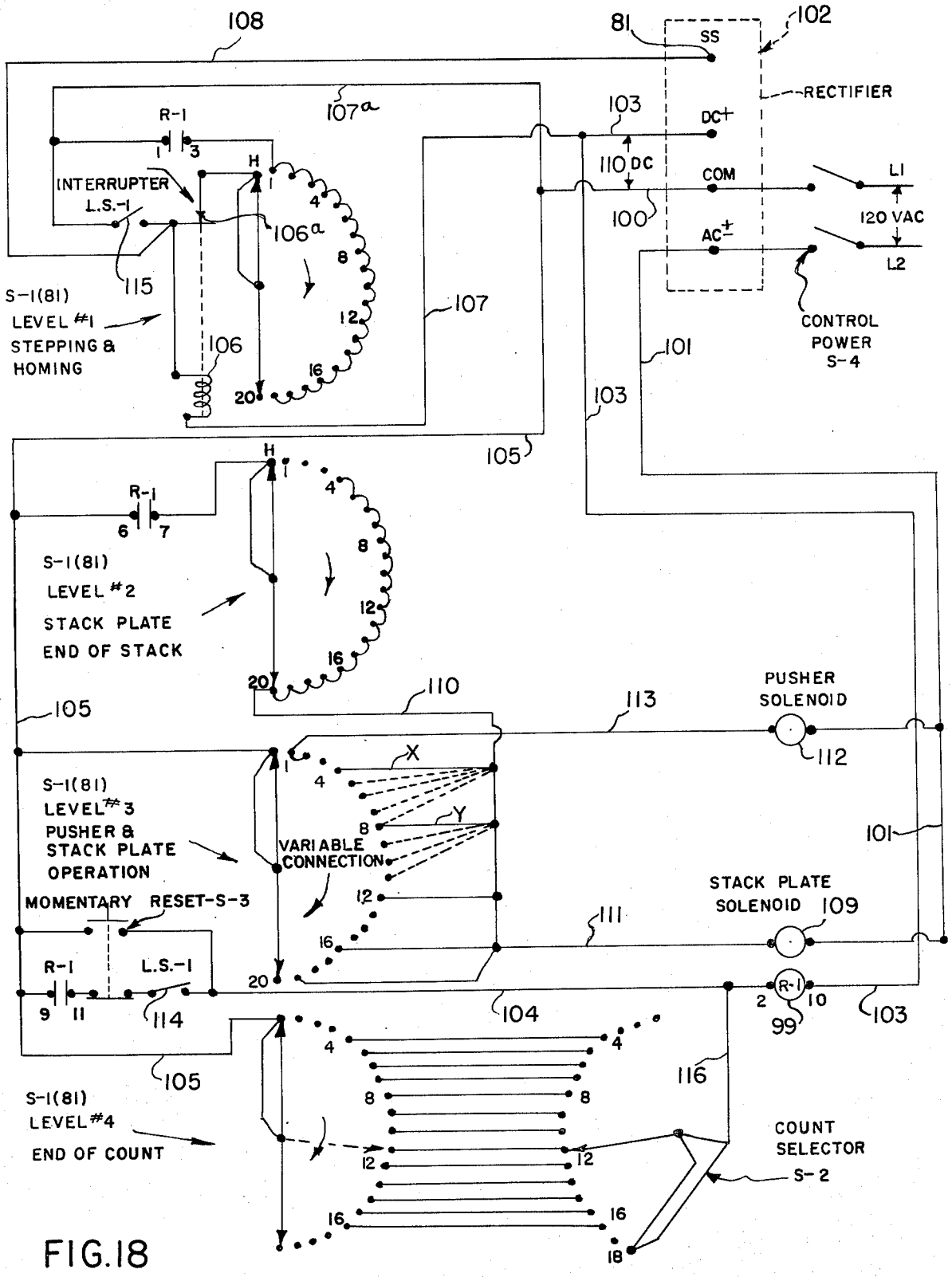
FIG. 18 is a diagrammatic view illustrating the operation of the electro-mechanical control means for the apparatus.

The sensing member is located sufficiently close to its associated feed belt so that it is actuated each time a patty passes the same. The sensing member is connected with an electro-mechanical controller 81, all held by frame-supported bar 81', which controls its associated lane independently of all other lanes. This means that one lane might be handling zero patties while another lane might be handling the maximum of which the machine is capable. The control device shown here and explained in more detail in connection with FIG. 18 is manufactured by C. P. Clare & Company of Chicago, Illinois Type 20, Switch SAA-04226. It should be understood that other devices might be utilized to perform these same control functions.

A motor 82, mounted on mounting plate 83 as shown in FIGS. 8 and 9, serves to drive the feed belt 23 and the hold-down belt 24. The motor 82 drives a sprocket 84 which is connected by drive chain 85 to a sprocket 86 which, together with sprocket 87 is mounted on a single hub 88 which is freely rotatable on shaft 38. Sprocket 87 is connected by drive chain 89 with sprocket 90 which drives feed belt shaft 25', sprocket 91 which drives hold-down belt shaft 27', and the chain also passes over a chain tightener sprocket 92.

A second electrical motor carried by mounting plate 93 as shown in FIG. 1 drives a sprocket 94 which is connected by drive chain 95 with drive sprocket 96 which is fixed on drive shaft **73*a* to drive the pulleys 73 which propel the take-away conveyor 72** previously described.

It should be understood that the electrical motors are supplied with power from a source not shown and air under pressure with suitable control valves not shown is provided for the cylinder and piston motors 34 and 60.

The control device 81 will be described in connection with counting substacks of four patties each and accumulating a plurality of these to form a final stack of eight, twelve, or sixteen. It will be indicated as the description proceeds how the number of patties may be varied in the substacks and in the final stack.

It has been mentioned previously that this device will stack patties at the rate of 120 per minute per lane with a considerable safety factor. This is a function of the controls. The stepping switch in the controlling member 81 (also referred to as S-1 in FIG. 18) will actually count external pulses at a rate as high as 1800 per minute. Gravity, however, limits the patty interval to a minimum of about 0.3 seconds for a patty handling rate of 200 per minute per lane. There is a second limiting factor which is the reset time on the step switch. The switch arrangement is such that 20 steps must be accomplished for each stack cycle, but the stack will usually be less than 20. The difference between 20 and the actual stack count must be accomplished by self-stepping the switch in patty time interval, the interval between the last patty of one stack and the first patty of a new stack. Suppose the stack count were eight. Then 12 steps must be accomplished before the new stack starts. The switch will self-step at 3600 cycles per minute or 60 steps per second. Thus those 12 steps may be accomplished in 12/60 equals 1/5 second. Thus it will be seen that the permitted stacking rate of one-half second per patty is adequately safe and that the machine does not operate at its ultimate limit.

It is understood that while this embodiment of the machine is limited to a stack count of sixteen, other switches and controls are available which would permit much greater stack counts.

Referring to FIG. 18, the operation of the stepping switch through a typical cycle will now be described.

1. Power switch S-4 is closed thus energizing from lines L1, L2 and lines 100 and 101 and at the same time energizing the rectifier 102 also energizes the DC line 103, and the stepping switch contact 81 SS.
   a. If the stepping switch S-1 is at the home step H, as shown, nothing happens, and S-3 need not be depressed.
   b. If S-1 is at other than home step H as shown, which will usually be the case, then the machine is not ready to count full stacks immediately and S-3 should be depressed momentarily to reset S-1 to zero, or home.
2. The operator depresses the momentary reset switch S-3 which has normally closed lower contacts and normally open upper contacts.
   a. Coil R-1 99 is energized through lines 103, 104 and 105. All R-1 contacts close.
   b. Referring to level No. 1 of the stepping switch, shown at the top of FIG. 18, if the switch S-1 is in home position, as shown, nothing happens at this level. If the stepping switch is in any other position, DC power is applied to the step switch coil 106 through the interrupter contact **106*a* and lines 107 and 107*a***. Then the switch steps home at 60 steps per second.
   c. At the stepping switch level No. 2 as indicated in FIG. 18, if step switch S-1 is at point 1, 2 or 3, nothing happens until the switch starts homing through level No. 1. At the homing point or at step No. 4, the stack plate solenoid 109 is energized through lines 110, 111 which acts through a solenoid operated part (not shown) retracting plate 33 toward the right as viewed in FIG. 5 by introducing air at the left-hand end of the cylinder and piston motor 34. This occurs as long as the reset switch S-3 remains depressed.
   d. At level No. 3 of the stepping switch as indicated in FIG. 18, if the stepping switch S-1 were at position 1 or 2, the pusher solenoid 112 would have been energized through lines 101 and 112 when the power switch S-4 was closed and the pusher 57 would have been extended, to the stack discharge position. If the stepping switch S-1 is at the home position, nothing happens. If the stepping switch homes through the action on level No. 1, then the stacker plate 33 is already retracted through the action at level No. 2 and nothing additional happens.
   e. At this time on level No. 4 of the stepping switch as seen at the bottom of FIG. 18, regardless of the position of the switch S-1, nothing happens.
3. The next step is to release the reset switch S-3.
   a. The solenoid coil R-1 at 99 is de-energized and all R-1 contacts open.
   b. The stack plate solenoid 109 is de-energized and the stack plate 33 is extended to the patty receiving position as shown in FIG. 5 by introducing air to the right-hand end of the cylinder and piston motor 34 by a standard operating valve controlled by 109 and not shown.
   c. The machine is now ready to operate.
4. Patty No. 1 strikes the sensing member 80 operating limit switch LS-1.
   a. LS-1 at 114 which is normally closed, then opens, and again closes as the patty leaves. (If coil R-1 99 had been energized, holding through R-1 (9-11), it would be de-energized).

b. LS-1 115 which is normally open closes and then opens as the patty passes. Stepping switch S-1 coil 106 is energized, then de-energized, and the switch steps once.

c. Since R-1 contacts (1-3) is open, nothing happens.

d. Level No. 2, nothing happens.

e. Level No. 3, the pusher solenoid 112 is energized from line 105 through the stepping arm in position 1 and line 113 and 101. The pusher 57 then starts to extend since solenoid 112 actuates an air valve not shown to energize the right-hand end of the cylinder and piston motor 60.

f. Level No. 4, nothing happens.

5. Patty No. 2 operates LS-1 as described in connection with the first patty.

a. At level No. 1 there is no effect except that the switch steps to No. 2.

b. Level No. 2, no new effect.

c. Level No. 3, the pusher 57 stays energized in its forward position.

d. Level No. 4, no effect.

6. Patty No. 3 operates LS-1.

a. At level No. 1, no effect except that the stepping switch moves up one more step.

b. Level No. 2, no effect.

c. Level No. 3, the pusher solenoid 112 is deenergized and pusher 57 retracts under the control of solenoid 112 which applies air to the left-hand end of the cylinder and piston motor 60 as viewed in FIG. 5.

d. Level No. 4, no effect.

7. Patty No. 4 operates LS-1.

a. Level No. 1, no effect except that the step switch moves up one more step.

b. Level No. 2, no effect because R-1 (contact 6-14 7) is open and there is no power applied.

c. Level No. 3, stack plate solenoid 109 is energized which through an air valve (not shown) retracts the stacker plate 33 by introducing air at the left-hand end of the cylinder and piston motor 34. This drops the first three patties which are in a substack resting upon the stacker plate 33 and the fourth patty after passing the sensing member 80 drops off the discharge end of the feed belt 23 after the stacker plate 33 has retracted so that it falls on top of the first three patties providing a substack of four in the stacker volume 55.

8. Patty No. 5 actuates LS-1 and the stepping switch advances one more step.

a. Level No. 1, no effect.

b. Level No. 2, no effect.

c. Level No. 3, the stack plate solenoid 109 is deenergized and stack plate 33 extends under control of solenoid 109 which applies air to the right-hand end of piston motor 34 as viewed in FIG. 5, thus catching patty No. 5 on 33.

d. Level No. 4, no effect.

9. Patty No. 6, no effect except the stepping switch moves one step forward.

10. Patty No. 7 actuates LS-1 and there is no effect except movement of the stepper switch one more step.

11. Patty No. 8 actuates switch LS-1 which repeats item No. 7 above.

12. Patty No. 9 actuates LS-1 and there is a repeat of item No. 8 above.

13. Patty 10 actuates LS-1 and no effect except stepping the switch one more step ahead.

14. Patty No. 11 actuates LS-1 and steps the stepper switch one notch ahead. Note that the count selector S-2 is on point 11 in FIG. 18.

a. The first effect is on level No. 4 wherein the R-1 coil 99 is energized through 105, 105*a*, the stepper switch arm, the count selector arm, 116 and 103. Thus all R-1 contacts close.

b. At level No. 1, the stepper switch travels home through the interrupter contact 106*a* at 60 steps per second.

c. At level No. 2, stack plate 33 is energized through solenoid 109 which acts through motor 34 as previously described, and stack plate 33 retracts while the homing of the stepper switch progresses.

d. At level No. 3, there is no further effect.

15. Patty No. 1 of the next stack actuates LS-1.

a. LS-1 at 114 opens, dropping out the R-1 coil 99 and all R-1 contacts open. Note that the stacker plate 33 extends at this time under control of solenoid 109 and the appropriate air valve to the extended position shown in FIG. 5 in order to catch this first patty. The process then repeats beginning with item No. 4, sub *b* above.

The control device is so arranged that the substack control wire X at level No. 3 of FIG. 18 may be easily changed to points 5, 6, 7 or 8. This change is arranged in such a manner that it requires no tools and can be done very quickly. The reason for providing this adaptability is to control the number of patties and hence the height of the first substack so as to assure its integrity while being dropped into the main stack volume 55.

The control device is so arranged so that control wire Y may be easily changed to points 9, 10, 11 or blank. This change is also arranged in such a manner that no tools are required. The reason for providing this adaptability is to control the height of the second substack so as to insure its integrity as described above. The combination of adaptabilities of X and Y also permits up to twelve patties to be collected with only two substacks for thin patties or as many as three substacks for thick patties.

The substack volume 56 in the embodiment described is three inches high. If the patties were 3/4 inch thick, then four would fill the volume (theoretically). Similarly, eight at ¾ inches thick and sixteen at 3/16 inches thick would fill the substack volume. In practice, bumps and curves on the patties limit the number to something less than this. When thin patties are dropped in a low count stack, they are less controllable than thick patties. In a low count stack, the difference in action in this machine is due to the overall stack height. When thin patties are stacked higher in the first substack, then stability approaches that acquired by thick patties. Therefore, the count in the first substack of the full stack should be increased for thin patties. It will be possible to extend this feature to permit almost any number to be counted into the first substack but eight appears to be the practical limit.

It may be seen from the above that the flexibility of positioning X and Y, plus the count selector S-2, combine to permit many well controllable combinations of substacks to reach any stack count from four to sixteen.

Single patties seldom discharge well from the substack volume 56 into the main stack volume 55. Therefore, it is suggested that each substack should include two or more patties.

Note that in the operation of this embodiment the first patty of a stack starts the stack pusher to remove the previous stack; the first patty of a substack moves the stack plate into position to catch that patty; the third patty of the first substack retracts the stack pusher; the last patty of the substack as it passes the sensing member 80 retracts the stack plate to allow the substack to fall into the main stack volume 55 while one patty in the air follows downward into the stack volume 55 on top of the previously collected substack; the last patty of a finished stack resets the stepping switch to zero.

Sometimes, patties are "shingled" during conveying. Such shingling to 25 percent of their length may momentarily increase the feed rate to 4/3 of the nominal or 160 per minute. Patties shingled 50 percent would double the feed rate momentarily to 240 per minute. This is mentioned as a reason for limiting capability of the machine to 120 patties per minute, to allow a reasonable safety factor to accommodate momentary speedups as described.

In a preferred operation of this embodiment, the speed of the feed belt and of the hold-down belt is sufficiently fast, approximately 180 feet per minute, to obtain horizontal discharge without excessive bounce from the stop 29*a*. This effect, combined with the slight climbing of the discharged patty between the offset pulleys 26 and 28, and controlled by the deflector plate 29, 29*b* results in a controlled delivery of the patty into the substack volume 56. Without these three controls, a patty might unpredictably rise out of the stack volume, dive into it, bounce, tilt, or otherwise randomly deliver, depending upon the extent of imperfections of the patty.

Estimated stack plate 33 operation time is about ⅛ to 1/10 second. The total effect is that the substack falls stright down into the stack volume 55 without disorientation. Ignoring any minor side drag on the substack, the drop of six inches is accomplished in approximately 0.175 seconds. The sum of stack plate operation (0.125 sec.) plus drop action (0.175sec.) equals 0.3 seconds, thus a theoretical cycle time of 60 divided by 0.3 equals 200 cycles per minute as being possible.

Note that this machine allows two normal patty intervals or one full second for moving the full stack out of the stack volume 55. This has been found sufficient for gentle handling of the stack without disorientation.

A scraper 120 for each belt 24 is mounted on a frame member 39*b*.

A standard flter-regulator-oiler unit is mounted at 121.

The above described machine will count and stack frozen or reasonably stiff patties, each on a piece of paper, or without paper. The machine is designed so that the hold-down belt serves to keep the patty in contact with the feed belt and thus to maintain the patty speed at the belt speed, regardless of patty or paper drag on the patty side guides 42, and regardless of any resistance encountered when passing the sensing means 80 which as mentioned before is a low torque limit switch.

This machine has been proved very effective in use and very dependable in counting and stacking large numbers of patties.

As used herein the term "patty" as used in the specification and claims includes frozen or moderately stiff meat patties or other flat food shapes either plain or frozen on paper, including waffles, pizza pies, fish portions, some cookies, and other flat shapes adapted for handling by the apparatus described herein.

What is claimed is:

1. A patty stacker comprising a frame; means on said frame for carrying a series of patties or the like along a linear path to a discharge point; a patty sensing member adjacent said path, a single stacker plate supported on said frame for reciprocating between a substack supporting position, below said discharge point and extending horizontally beyond the discharge point of said path, and a substack dropping position withdrawn from said supporting position; means supported by said frame for reciprocating said stacker plate responsive to a signal from said sensing member between said positions and sufficiently fast to said dropping position to release said substack with substantially no tilting effect; means supported by said frame in line with said path and spaced from said discharge point and above the level of said stacker plate for stopping each patty in a predetermined vertical line; a finished stack support underlying a stack volume fixed on said frame directly beneath, and spaced from, said stacker plate in said substack supporting position; parallel stack guides carried by said frame and spaced on opposite sides of said support parallel to said linear path and extending for the major part of the distance from said support to said stacker plate in said substack supporting position; movable door means at least partially closing the space between said stack guides in the downstream direction; pusher means carried by said frame and having a vertical face at least substantially of minimum patty width normally positioned in the spaces between said stack guides on the upstream side of said support completing a stack volume; means for reciprocating said pusher from said normal position sufficiently to push a stack of patties from said support through said door means; means beyond said door means at the level of said support to receive a stack propelled by said pusher; and adjustable electromechanical counting and stepping switch control means responsive to said patty sensing member for causing the counting and stacking of a plurality of patties of a set number, more than two, on said stacker plate in a first substack which is reasonably stable, for then operating said stack plate reciprocating means to drop said first substack on said support, for then causing the counting and stacking of at least a second substack of a plurality of patties on said stacker plate and again operating said stacker plate reciprocating means to drop said second substack upon said first substack, and for continuing said counting, stacking and dropping until a finished stack of predetermined selected number is formed, and for then actuating said means for reciprocating said pusher to push said finished stack through said movable door means, and wherein said means for carrying said patties along a linear path comprises a lower flat endless belt extending over a drive pulley and an idler pulley and an upper endless round hold-down belt parallel to and approximately above the centerline of said flat belt; said round belt extending over a grooved drive pulley and a grooved idler pulley; means for driving said two driving pulleys; means for adjusting the distance between said flat and round belts to accommodate patties of varying thickness; said driving pulleys being at the product-entering end of said belts with their axes in the same vertical plane; and said idler pulleys at the product-discharge end of said belts having the axis of rotation of the hold-down belt pulley upstream from the axis of rotation of the feed belt pulley a short distance sufficient to cause a discharged patty to climb slightly upward and outward a little above the horizontal plane of said feed belt.

2. A patty stacker as defined in claim 1, wherein an annular groove substantially complementary to said round belt is provided on the periphery of said drive pulley for said hold-down belt; and said last named drive pulley having an outside diameter sightly greater than the outside diameter of said round belt in said groove; whereby to positively pinch a patty entering between said two drive pulleys.

3. A patty stacker as defined in claim 1, including parallel vertical plate patty guides extending along opposite sides of said flat feed belt for substantially its entire upper patty-carrying run; said plate extending beyond the delivery end of said feed belt and there extending downwardly and forming vertical side walls of a substack volume; and means for adjusting the spacing between said patty guides to accommodate patties of varying width.

4. A patty stacker as defined in claim 1, wherein said means for stopping each patty in a vertical line comprises a stop generally L-shape in section having a horizontal portion slightly above the level of the upper surface of a patty lying on said feed belt; said portion having an upturned edge crosswise of said feed belt in position to assist in catching a patty climbing upward and outward and to direct the same in a substantially horizontal path; and said stop having a vertical portion opposite to and spaced from said discharge point.

5. A patty stacker as defined in claim 4, wherein said means for carrying said patties along a linear path comprises a motor having a driving speed arranged to carry said patties at a speed sufficiently fast to obtain substantially horizontal discharge of each patty without excessive bounce from said patty stop vertical portion.

6. A plurality of patty stackers, each patty stacker comprising a frame; means on said frame for carrying a series of patties or the like along a linear path to a discharge point, the linear paths of said plurality of patty stackers being parallel; a patty sensing member adjacent said path, a single stacker plate supported on said frame for reciprocation between a substack supporting position, below said discharge point and extending horizontally beyond the discharge point of said path, and a substack dropping position withdrawn from said supporting position; means supported by said frame for reciprocating said stacker plate responsive to a signal from said sensing member between said positions and sufficiently fast to said dropping position to release said substack with substantially no tilting effect; means supported by said frame in line with said path and spaced from said discharge point and above the level of said stacker plate for stopping each patty in a predetermined vertical line; a finished stack support underlying a stack volume fixed on said frame directly beneath, and spaced from, said stacker plate in said substack supporting position; parallel stack guides carried by said frame and spaced on opposite sides of said support parallel to said linear path and extending for the major part of the distance from said support to said stacker plate in said substack supporting position; movable door means at least partially closing the space between said stack guides in the downstream direction; pusher means carried by said frame and having a vertical face at least substantially of minimum patty width normally positioned in the spaces between said stack guides on the upstream side of said support completing a stack volume; means for reciprocating said pusher from said normal position sufficiently to push a stack of patties from said support through said door means; means beyond said door means at the level of said support to receive a stack propelled by said pusher; and adjustable electromechanical counting and stepping switch control means responsive to said patty sensing member for causing the counting and stacking of a plurality of patties of a set number, more than two, on said stacker plate in a first substack which is reasonably stable, for then operating said stack plate reciprocating means to drop said first substack on said support, for then causing the counting and stacking of at least a second substack of a plurality of patties on said stacker plate and again operating said stacker plate reciprocating means to drop sad second substack, and for continuing said counting, stacking and dropping until a finished stack of predetermined selected number is formed, and for then actuating said means for reciprocating said pusher to push said finished stack through said movable door means, including means on said frame mounting said stack guides for simultaneous movement longitudinally forward and back to vary the length of said stack volume, said last named means comprising a plurality of bars extending crosswise of said paths and welded to each of said stack guides and said bars carried by a cross head on each side of said machine, each of said cross heads being adjustable on a fixed cross head guide slide.

7. A patty stacker as defined in claim 6, wherein said last named means includes means for adjusting simultaneously the spacing between said stack guides to accommodate patties of varying width, said last named means comprising a plurality of parallel horizontal bars extending crosswise of said lanes, part of said last named bars being welded to all of said left-hand stack guides, and others of said last named bars being welded to said right-hand stack guides.

8. A patty comprising a pluraity of stackers as defined in claim 7; said stackers being arranged in individual lanes which are independent of each other, said frame being common to all lanes; said means for carrying said patties along a linear path comprising a flat feed belt and a coacting round hold-down belt in each lane with all feed belts mounted in a common subframe and all hold-down belts mounted in a common subframe and common means is provided for adjustng the spacing between said subframes; parallel patty guides in each lane extending substantailly the full length on each side of each feed belt and extending below the level of said flat feed belt and extending beyond the discharge end of said feed belts and there providing side walls of a substack volume in each lane, common means including rigid guide bars welded to all left-hand patty guides is provided to adjust all left-hand patty guides simultaneously and including rigid guide bars welded to all right-hand patty guides to adjust all right-hand patty guides simultaneously; and said means on said frame mounting said stack guides provides common means for adjusting all of said right-hand stack guides simultaneously and common means to adjust all of said left-hand stack guides simultaneously and common means for adjusting all of said stack guides longitudinally forward and back simultaneously.

9. A patty stacker comprising a frame; means on said frame for carrying a series of patties or the like along a linear path to a discharge point; a patty sensing member adjacent said path, a single stacker plate supported on said frame for reciprocation between a substack supporting position, below said discharge point and extending horizontally beyond the discharge point of said path, and a substack dropping position withdrawn from said supporting position; means supported by said frame for reciprocating said stacker plate responsive to a signal from said sensing member between said positions and sufficiently fast to said dropping position to release said substack with substantially to tilting effect; means supported by said frame in line with said path and spaced from said discharge point and above the level of said stacker plate for stopping each patty in a predetermined vertical line; a finished stack support underlying a stack volume fixed on said frame directly beneath, and spaced from, said stacker plate in said substack supporting position; parallel stack guides carried by said frame and spaced on opposite sides of said support parallel to said linear path and extending for the major part of the distance from said support to said stacker plate in said substack supporting position; movable door means at least partially closing the space between said stack guides in the downstream direction; pusher means carried by said frame and having a vertical face at least substantially of minimum patty width normally positioned in the spaces between said stack guides on the upstream side of said support completing a stack volume; means for reciprocating said pusher from said normal position sufficiently to push a stack of patties from said support through said door means; means beyond said door means at the level of said support to receive a stack propelled by said pusher; and adjustable electromechanical counting and stepping switch control means responsive to said patty sensing member for causing the counting and stacking of a plurality of patties of a set number, more than two, on said stacker plate in a first substack which is reasonably stable, for then operating said stack plate reciprocating means to drop said first substack on said support, for then causing the counting and stacking of at least a second substack of a plurality of patties on said stacker plate and again operating said stacker plate reciprocating means to drop said second substack, and for continuing said counting, stacking and dropping until a finished stack of predetermined selected number is formed, and for then actuating said means for reciprocating said pusher to push said finished stack through said movable door means, wherein said control means operates said stack plate reciprocating means to drop said first and subsequent substacks toward said support when said plurality of patties is one less than said set number; and said stack plate reciprocating means is so timed as to permit the last patty in said number to fall directly into said finished stack volume and then to move into substack supporting position in time to receive the first patty in the next substack.

* * * * *